US010538126B2

(12) United States Patent
Hutchison

(10) Patent No.: US 10,538,126 B2
(45) Date of Patent: Jan. 21, 2020

(54) PAINTBRUSH UTILITY CONTAINER

(71) Applicant: Wayne Terry Hutchison, Myrtle Beach, SC (US)

(72) Inventor: Wayne Terry Hutchison, Myrtle Beach, SC (US)

( * ) Notice: Subject to any disclaimer, the term of this patent is extended or adjusted under 35 U.S.C. 154(b) by 0 days.

(21) Appl. No.: 16/428,258

(22) Filed: May 31, 2019

(65) Prior Publication Data

US 2019/0366758 A1 Dec. 5, 2019

Related U.S. Application Data

(60) Provisional application No. 62/763,040, filed on Jun. 1, 2018.

(51) Int. Cl.
*B44D 3/12* (2006.01)
*B25H 3/00* (2006.01)
*A46B 17/02* (2006.01)

(52) U.S. Cl.
CPC ..... *B44D 3/125* (2013.01); *A46B 17/02* (2013.01); *B25H 3/00* (2013.01)

(58) Field of Classification Search
CPC ..... A45C 13/02; B25H 3/023; B44D 3/125; Y10T 24/314; A46B 17/04; A46B 17/00; A46B 17/02; B65D 25/10
USPC .... 206/372, 757, 234, 379, 361, 362, 362.1, 206/362.2, 362.3, 349, 209, 575; 224/236, 679; 190/40; 211/65; 220/736
See application file for complete search history.

(56) References Cited

U.S. PATENT DOCUMENTS 1,471,712 A * 10/1923 Sohnle ..... B44D 3/125 206/362
1,667,044 A 4/1928 Oddo
1,830,200 A 11/1931 Hall
2,020,394 A * 11/1935 Bates ..... B65D 83/02 206/362
RE21,386 E * 3/1940 Crawford ..... B44D 3/125 206/362
2,278,650 A * 4/1942 Drinkwater ..... B44D 3/123 211/65
2,399,056 A * 4/1946 Oller ..... B44D 3/123 211/65
2,479,509 A * 8/1949 Pichniarczyk ..... B44D 3/125 206/362
2,622,728 A * 12/1952 Lieberman ..... A46B 17/04 206/362

(Continued)

*Primary Examiner* — Gideon R Weinerth
(74) *Attorney, Agent, or Firm* — Dale J. Ream

(57) ABSTRACT

A paintbrush utility container for stowing paintbrushes and associated shucks includes a brush bag having a first portion pivotally coupled to and extending from a first lateral edge of a bottom wall and including a second portion pivotally coupled to and extending from a second lateral edge of the bottom wall. A plurality of first pockets are situated on the first portion and a plurality of second pockets are situated on the second portion, each respective pocket defining an interior space dimensioned to receive a respective paintbrush shuck and a respective open end giving access to the interior space. The first and second portions include upper ends, respectively, and are pivotally movable from an open configuration in which the first upper end is displaced from the second end and a closed configuration in which the first upper end bears against the second upper end.

17 Claims, 2 Drawing Sheets

(56) References Cited

U.S. PATENT DOCUMENTS 2,631,632 A * 3/1953 Leachman ..... A45C 3/00 190/109
2,675,042 A * 4/1954 Herrera ..... A45C 13/02 150/112
2,744,621 A * 5/1956 Kegevic ..... B25H 3/02 312/293.2
4,523,702 A * 6/1985 Viio ..... A45F 5/00 206/479
4,607,752 A * 8/1986 Sherrow ..... B25B 11/00 211/65
4,718,524 A * 1/1988 Crumley ..... A45C 3/00 150/113
4,811,769 A * 3/1989 Phares ..... A45C 13/02 150/104
D314,470 S * 2/1991 Hutchins ..... D3/283
5,423,404 A * 6/1995 Shaw ..... A45C 3/00 190/102
D360,977 S * 8/1995 Katz ..... D3/276
5,797,489 A 8/1998 Baker
5,799,791 A * 9/1998 Harley ..... A47G 1/12 190/102
5,947,286 A * 9/1999 Chau ..... B25H 3/023 190/40
6,338,406 B1 * 1/2002 Zagar ..... A46B 17/04 206/15.3
D621,614 S * 8/2010 Zuniga ..... D3/282
7,946,418 B1 * 5/2011 Cerynik ..... B25H 3/021 206/350
8,939,286 B2 * 1/2015 Hesse ..... B44D 3/125 206/361
2004/0065573 A1 * 4/2004 Brouard ..... A45C 13/02 206/373
2005/0247030 A1 * 11/2005 Phillips ..... B44D 3/125 53/397
2008/0210593 A1 * 9/2008 Cornwell ..... B25H 3/003 206/747
2013/0112580 A1 * 5/2013 Johnson ..... B44D 3/125 206/361
2013/0233735 A1 9/2013 Hurley et al.
2013/0299362 A1 * 11/2013 DePaola, Jr. ..... B44D 3/125 206/1.7

* cited by examiner

PAINTBRUSH UTILITY CONTAINER

REFERENCE TO RELATED APPLICATIONS

This application claims the benefit of provisional patent application U.S. Ser. No. 62/763,040 filed Jun. 1, 2018 titled Paintbrush Utility Tote and which is incorporated herein by reference.

FIELD OF THE INVENTION

The present invention relates generally to tool carrying cases and, in particular, to a paintbrush container for holding paintbrushes with paintbrush covers in designed pockets for protection, easy access, and organization purposes.

BACKGROUND OF THE INVENTION

With the cost of professional paintbrushes being at a premium, it is important to store them properly as to not damage the bristles which would deem them unusable. Paintbrush bristles are continuously damaged due to not having a shuck on them or being stored in a catch-all tool bucket or toolbox which can easily pick up dirt and grease. Further, not having a central location for paintbrushes and paintbrush shucks often causes a misplacement of the paintbrush shuck which in turn means loss of a new or used paintbrush since there is no longer a protection device for the bristles. Being able to store paintbrushes and paintbrush shucks on a jobsite, in a vehicle, or at home in an organized manner is a constant struggle. Misplacement and organization of interior brushes, exterior brushes, oil based brushes, and latex based brushes can be time consuming and frustrating. Having several options for particular paintbrushes in a central location where they are easily accessed and organized is not an option with the tool cases today. The present invention will solve the issues of improper storage, accessibility, and manageability of professional paintbrushes.

Present inventions fail to meet the need of the problems associated with proper care and manageability as exemplified in U.S. Pat. No. 5,797,489 issued to Baker which uses a hard cased container that only partially opens and holds paintbrushes handle down which causes liquids to rust the brush bands and has no shuck. U.S. Pat. No. 7,946,418 issued to Cerynik uses magnets to hold brushes by the metal band which causes unnecessary weight in an already heavy container, but also causes rust on the metal band. This invention also has no bristle protecting shuck. Design U.S. Pat. No. 621,614 issued to Zuniga & Munoz uses a metal case which is difficult to open and close and difficult to remove contents. Other examples which hold brushes improperly with no shucks include these from the art field that use straps to hold brushes as in U.S. Pat. No. 4,573,569 issued to Parker and U.S. Pat. No. 1,667,044 issued to Oddo, U.S. Pat. No. 1,471,712 issued to Sohnle and U.S. Pat. No. 130,401 issued to Ames are all heavy, bulky, and do not store paintbrushes properly with the shuck. None of the mentioned examples meet the need for a proper and easy to use paintbrush container.

Therefore, it would be desirable to have a paintbrush utility container having a flexible construction that can lay flat and open or, conversely, be folded and closed and, as a result, be used or stored from a vehicle, job site, or the like. Further, it would be desirable to have a paintbrush utility container having a plurality of paintbrush pockets each of which continue to hold associated shucks while an associated paintbrush is removed for use. In addition, it would be desirable to have a paintbrush utility container that securely holds a plurality of paintbrushes in a manner not leading to rust or damage to respective paintbrushes stored therein.

SUMMARY OF THE INVENTION

A paintbrush utility container for stowing a plurality of paintbrushes and a plurality of shucks associated with the plurality of paintbrushes according to the present invention includes a brush bag having a bottom wall having a first lateral edge and a second lateral edge opposite the first lateral edge, the brush bag including a first portion pivotally coupled to and extending from the first lateral edge and including a second portion pivotally coupled to and extending from the second lateral edge. A plurality of first pockets are situated on a first inner surface of the first portion of the brush bag, each first pocket of the first plurality of first pockets defining a first interior space dimensioned to receive a respective shuck and a first open end giving access to the first interior space. A plurality of second pockets are situated on a second inner surface of the second portion of the brush bag, each second pocket of the plurality of second pockets defining a second interior space dimensioned to receive another respective shuck and a second open end giving access to the second interior space. The first portion and the second portion include a first upper end and a second upper end, respectively, the first portion and the second portion being pivotally movable from an open configuration in which the first upper end is displaced from the second end and a closed configuration in which the first upper end bears against the second upper end.

Therefore, a general object of this invention is to provide a paintbrush utility container having a flexible construction for movement between an open laid flat configuration and a closed folded configuration.

Another object of this invention is to provide a paintbrush utility container, as aforesaid, having first and second portions each of which includes a plurality of pockets configured to receive a plurality of paintbrushes and associated shucks.

Still another object of this invention is to provide a paintbrush utility container, as aforesaid, that is easy and light weight to carry, easy to store, and convenient to use on a job site.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
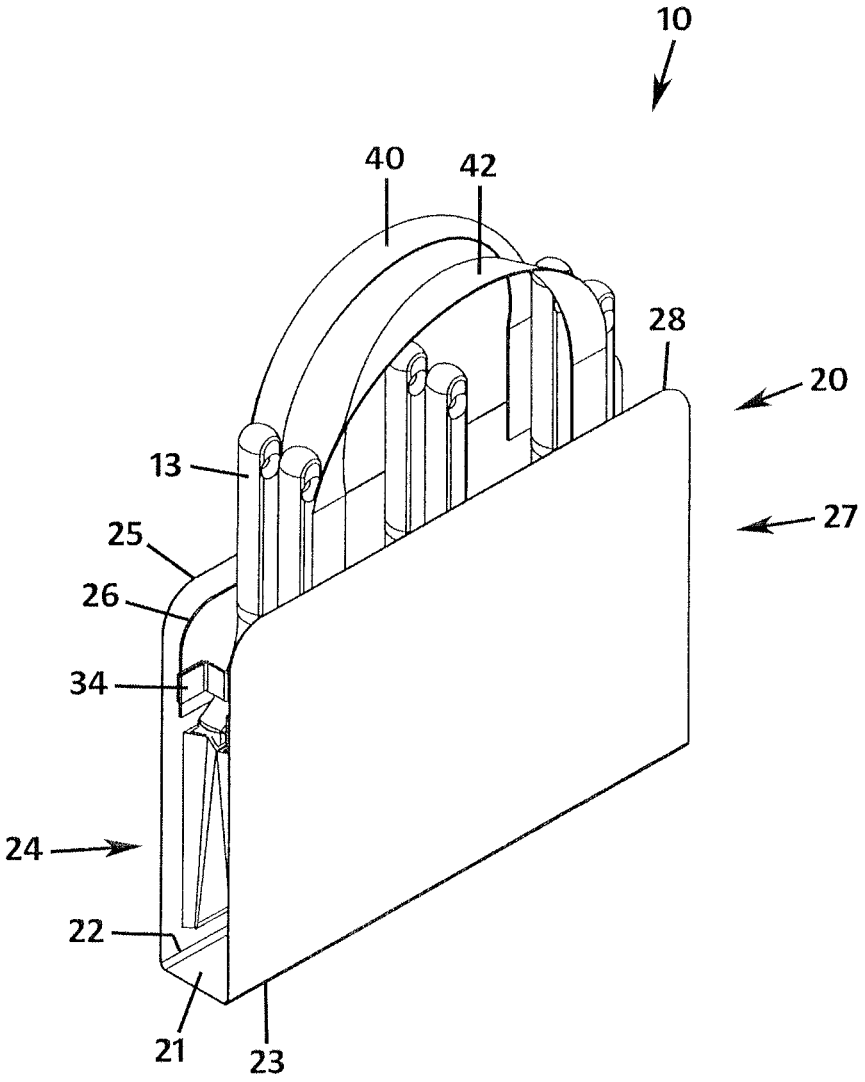
FIG. 1 is a perspective view of a paintbrush utility container according to an embodiment of the present invention, illustrated in a closed configuration.

A paintbrush utility container according to a preferred embodiment of the present invention will now be described in detail with reference to FIGS. 1 to 2*c* of the accompanying drawings. The paintbrush utility container 10 includes a brush bag 20, a plurality of first pockets 30, a plurality of second pockets 32, and supporting structures as described below.

The brush bag 20 is the fundamental component of the paintbrush utility container 10 and includes a durable yet flexible construction movable between open and closed configuration and easily storable and usable in a vehicle, in a work environment, or a residence. More particularly, the brush bag 20 includes a bottom wall 21 having a first lateral edge 22 and a second lateral edge 23 opposite the first lateral edge 22, the lateral edges being connected by opposed end edges, respectively. The portions (i.e. "wings" of the bag may pivot about the lateral edges. In addition, the first and second portions 24, 27 include first and second upper edges 25, 28, respectively, that are opposite first and second lateral edges 22, 23, respectively. The bottom wall 21 may include ridges and is durable so that other tools may be placed thereon in use, such as a paint container, scrapers, and the like.

Further, the brush bag 20 includes a first portion 24 coupled to the first lateral edge 22 and extending away from the bottom wall 21. Similarly, the brush bag 20 includes a second portion 27 coupled to the second lateral edge 23 and extending away from the bottom wall 21. The first and second portions 24, 27 are substantially mirror images of one another. The first and second portions 24, 27 are pivotally movable about laterals edges 22, 23, respectively. More particularly, the first and second portions 24, 27 are pivotally movable between an "open" configuration that may be laid out flat and co-planar with the bottom wall 21. At the open configuration, the upper edges 25, 28 of the first and second portions 24, 27 are displaced from one another. Similarly, the first and second portions 24, 27 may be pivoted respectively about the lateral edges 22, 23, respectively, to a "closed" configuration in which upper edges 25, 28, respectively, bear against one another.

More particularly, the upper edges may include complementary fasteners that, when engaged, hold the upper edges 25, 28 together at the closed configuration in a friction fit engagement. For instance, the fasteners may be complementary hook and loop fasteners. For instance, the first upper edge 25 may include a first fastener 26 such as a hook fastener and the second upper edge 28 may include a second fastener 29 such as a loop fastener, or vice versa. The fasteners may be arranged as square patterns, linear in nature, or other arrangements. Of course, fasteners other than a hook and loop fastener combination may also work, such as clasps, snaps, buckles, laces, lathes, magnets, and the like. Obviously, the pockets are accessible at the open configuration but are not accessible at the closed configuration.

The brush bag 20, in general, and the first and second portions 24, 27, specifically, are constructed of a flexible yet durable material. The first and second portions 24, 27 each include opposed inner and outer surfaces, respectively, the pockets being positioned on respective inner surfaces and the outer surfaces, respectively, being protective thereof at the closed configuration. At least the outer surfaces may be constructed of a polyvinyl chloride (PVC) backed polyester material.

Figure 2A:
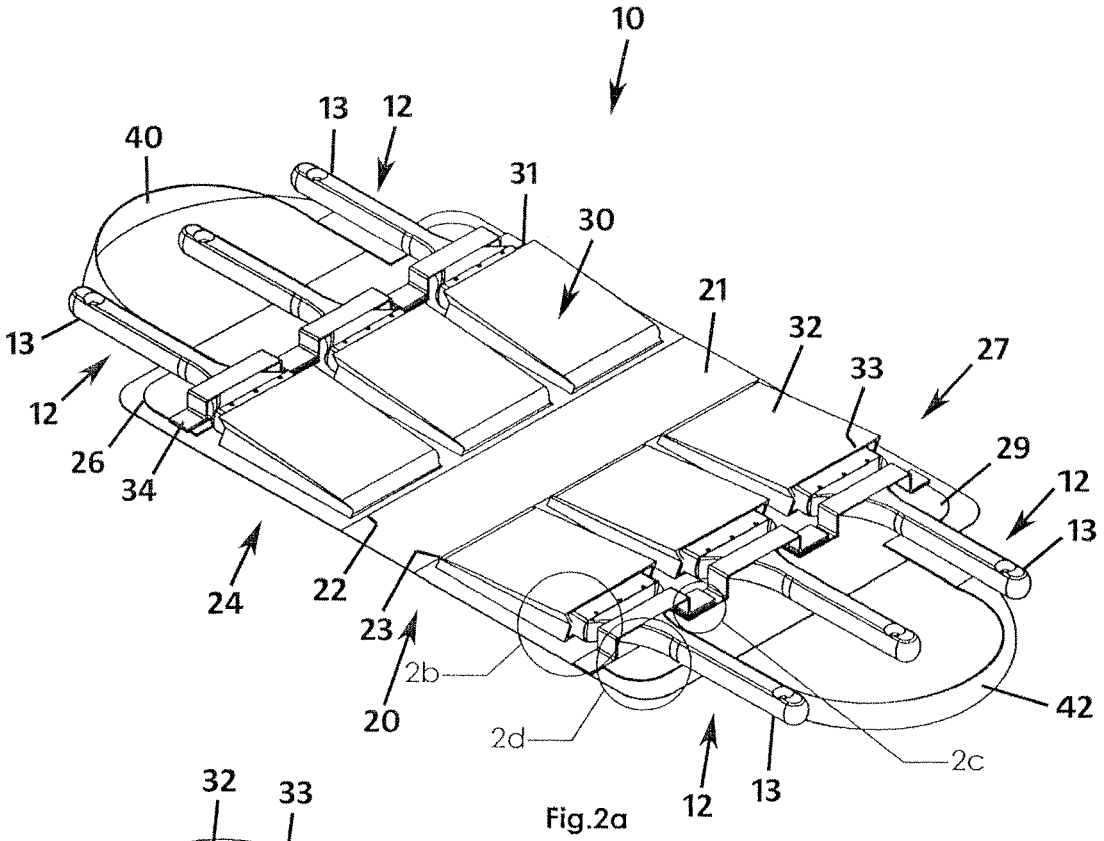
FIG. 2*a* is another perspective view of the paintbrush utility container as in FIG. 1, illustrated in an open configuration.
Figure 2B:
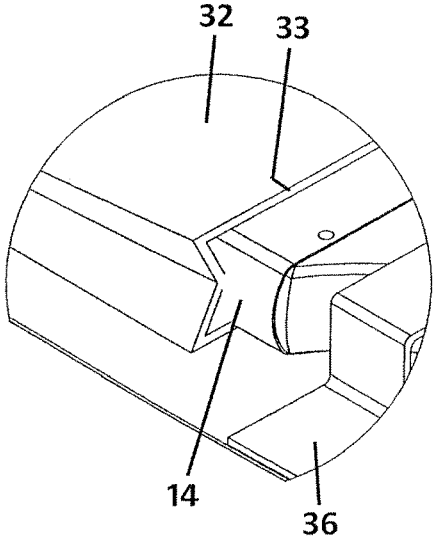
FIG. 2*b* is an isolated view on an enlarged scale taken from FIG. 2*a;*
Figure 2C:
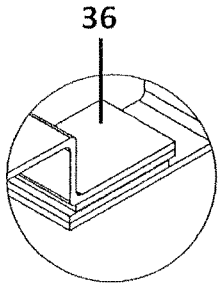
FIG. 2*c* is an isolated view on an enlarged scale taken from FIG. 2*a*.
Figure 2D:
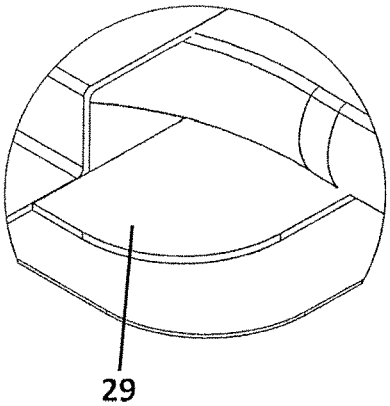
FIG. 2*d* is an isolated view on an enlarged scale taken from FIG. 2*a*.

In a critical aspect, the paintbrush utility container 10 includes a plurality of first pockets 30 mounted and positioned on the inner surface of the first portion of the brush bag 20 (FIG. 2*a*). Each first pocket 30 is spaced apart from an adjacent first pocket 30, has a plurality of first pocket walls that together define a first interior space, and define a first open end 31 operable to provide access to the first interior space. It is understood that the first open end 31 is adjacent to and directed toward the first upper edge 25.

Similarly, the paintbrush utility container 10 includes a plurality of second pockets 32 mounted and positioned on the inner surface of the second portion of the brush bag 20 (FIG. 2*a*). Each second pocket 32 is spaced apart from an adjacent second pocket 32, has a plurality of second pocket walls that together define a second interior space, and define a second open end 33 operable to provide access to the second interior space. It is understood that the second open end 33 is adjacent to and directed toward the second upper edge 28.

With further reference to the pockets, each pocket may have a generally V-shaped configuration dimensioned to receive a shuck 14 associated with a paintbrush 12 in a relatively tight friction fit relationship so that the shuck 14 may be securely held therein while the associated paintbrush 12 has been withdrawn, such as for use in painting.

In another aspect, the paintbrush utility container 10 includes a plurality of containment straps that are each operable to secure a handle 13 of a respective paintbrush 12 to the inner surfaces of the first and second portions 24, 27 of the brush bag 20. Specifically, a plurality of first containment straps 34 is coupled to the first portion 24 of the brush bag 20 and a plurality of second containment straps 36 is coupled to the second portion 27 of the brush bag 20. Preferably, each containment strap includes an elongate strip of hook and loop fasteners arranged to selectively secure the handle 13 of a paintbrush 12 received in a respective pocket.

In still another aspect, the paintbrush utility container 10 includes a pair of carrying handles. More particularly, a first carrying handle 40 is coupled to and extends away from the first upper edge of the first portion 24 of the brush bag 20. Similarly, a second carrying handle 42 is coupled to and extends away from the second upper edge of the second portion 27 of the brush bag 20.

In use, paintbrushes 12—including their associated shucks 14—may be inserted into respective pockets of the brush bag 20 when the brush bag 20 is in the open configuration, i.e. when opened and laid flat with the inner surface (i.e. pocket side) is facing upwardly. A desired paintbrush 12 may be removed from its shuck 14 (such as for use in painting) but with the shuck remaining in the respective pocket. Then, following use and cleanup, the paintbrush may be re-inserted into the associated shuck and the handle 13 of the paintbrush 12 secured via a respective containment strap.

It is understood that while certain forms of this invention have been illustrated and described, it is not limited thereto except insofar as such limitations are included in the following claims and allowable functional equivalents thereof.

The invention claimed is:

1. A paintbrush utility container for stowing a plurality of paintbrushes and a plurality of shucks associated with the plurality of paintbrushes, said paintbrush utility container, comprising:

a brush bag that includes a bottom wall having a first lateral edge and a second lateral edge opposite said first lateral edge, said brush bag including a first portion pivotally coupled to and extending from said first lateral edge and including a second portion pivotally coupled to and extending from said second lateral edge;

a plurality of first pockets situated on a first inner surface of said first portion of said brush bag, each first pocket of said first plurality of first pockets defining a first interior space dimensioned to receive a respective shuck and a first open end giving access to said first interior space;

a plurality of second pockets situated on a second inner surface of said second portion of said brush bag, each second pocket of said plurality of second pockets defining a second interior space dimensioned to receive another respective shuck and a second open end giving access to said second interior space;

wherein said first portion and said second portion include a first upper end and a second upper end, respectively, said first portion and said second portion being pivotally movable from an open configuration in which said first upper end is displaced from said second end and a closed configuration in which said first upper end bears against said second upper end; and wherein the plurality of first and second pockets are positioned so that a handle of each of the plurality of paintbrushes extends beyond the first and second upper ends of the first and second portions when said paintbrushes are stored in said pockets.

2. The paintbrush utility container as in claim 1, wherein said first portion and said second portion are constructed of a flexible material.

3. The paintbrush utility container as in claim 1, wherein said brush bag includes a first fastener fixedly attached to an inner surface of said first upper end and a second fastener fixedly attached to an inner surface of said second upper end, said first fastener being coupled to said second fastener at said closed configuration.

4. The paintbrush utility container as in claim 3, wherein:

said first fastener is a hook fastener; and said second fastener is a loop fastener that is complementary and operable to selectively receive said hook fastener of said first fastener.

5. The paintbrush utility container as in claim 1, wherein:

each said first pocket has a V-shaped configuration operable to receive said respective shuck;

each said second pocket has a V-shaped configuration operable to receive said another respective shuck.

6. The paintbrush utility container as in claim 1, wherein:

each said first pocket has an interior dimension operable to receive and hold said respective shuck in a friction fit engagement;

each said second pocket has an interior dimension operable to receive and hold said another shuck in a friction fit engagement.

7. The paintbrush utility container as in claim 1, further comprising:

a first carrying handle mounted to and extending away from said first lateral edge of said first portion of said brush bag; and a second carrying handle mounted to and extending away from said second lateral edge of said second portion of said brush bag.

8. The paintbrush utility container as in claim 1, wherein:

said brush bag includes a first outer surface opposite said first inner surface and constructed of a polyvinyl chloride (PVC) backed polyester material; and said brush bag includes a second outer surface opposite said second inner surface and constructed of a polyvinyl chloride (PVC) backed polyester material.

9. The paintbrush utility container as in claim 1, wherein said brush bag is laid flat for access to said plurality of first pockets and said plurality of second pockets at said open configuration and said brush bag is closed for preventing access to said plurality of first pockets and said plurality of second pockets at said closed configuration.

10. A paintbrush utility container for stowing a plurality of paintbrushes and a plurality of shucks associated with the plurality of paintbrushes, said paintbrush utility container, comprising:

a brush bag that includes a bottom wall having a first lateral edge and a second lateral edge opposite said first lateral edge, said brush bag including a first portion pivotally coupled to and extending from said first lateral edge and including a second portion pivotally coupled to and extending from said second lateral edge;

a plurality of first pockets situated on a first inner surface of said first portion of said brush bag, each first pocket of said first plurality of first pockets defining a first interior space dimensioned to receive a respective shuck and a first open end giving access to said first interior space;

a plurality of second pockets situated on a second inner surface of said second portion of said brush bag, each second pocket of said plurality of second pockets defining a second interior space dimensioned to receive another respective shuck and a second open end giving access to said second interior space;

wherein said first portion and said second portion include a first upper end and a second upper end, respectively, said first portion and said second portion being pivotally movable from an open configuration in which said first upper end is moved away from said second end and a closed configuration in which said first upper end bears against said second upper end;

a plurality of first containment straps coupled to said first portion of said brush bag, each first containment strap laterally spaced from a respective first open end of a respective first pocket and having hook and loop fasteners; and a plurality of second containment straps coupled to said second portion of said brush bag, each second containment strap laterally spaced from a respective second open end of a respective second pocket and having hook and loop fasteners; and wherein the plurality of first and second pockets are positioned so that a handle of each of the plurality of paintbrushes extends beyond the first and second upper ends of the first and second portions when said paintbrushes are stored in said pockets.

11. The paintbrush utility container as in claim 10, wherein said brush bag includes a first fastener fixedly attached to an inner surface of said first upper end and a second fastener fixedly attached to an inner surface of said second upper end, said first fastener being coupled to said second fastener at said closed configuration.

12. The paintbrush utility container as in claim 11, wherein:

said first fastener is a hook fastener; and said second fastener is a loop fastener that is complementary and operable to selectively receive said hook fastener of said first fastener.

13. The paintbrush utility container as in claim 10, wherein:

each said first pocket has a V-shaped configuration operable to receive said respective shuck;

each said second pocket has a V-shaped configuration operable to receive said another respective shuck.

14. The paintbrush utility container as in claim 10, wherein:

each said first pocket has an interior dimension operable to receive and hold said respective shuck in a friction fit engagement;

each said second pocket has an interior dimension operable to receive and hold said another shuck in a friction fit engagement.

15. The paintbrush utility container as in claim 10, further comprising:

a first carrying handle mounted to and extending away from said first lateral edge of said first portion of said brush bag; and a second carrying handle mounted to and extending away from said second lateral edge of said second portion of said brush bag.

16. The paintbrush utility container as in claim 10, wherein:

said brush bag includes a first outer surface opposite said first inner surface and constructed of a polyvinyl chloride (PVC) backed polyester material; and said brush bag includes a second outer surface opposite said second inner surface and constructed of a polyvinyl chloride (PVC) backed polyester material.

17. The paintbrush utility container as in claim 10, wherein said brush bag is laid flat for access to said plurality of first pockets and said plurality of second pockets at said open configuration and said brush bag is closed for preventing access to said plurality of first pockets and said plurality of second pockets at said closed configuration.

* * * * *